US007859482B1

(12) United States Patent
Herting

(10) Patent No.: US 7,859,482 B1
(45) Date of Patent: Dec. 28, 2010

(54) FREQUENCY SELECTIVE SURFACE WAVEGUIDE SWITCH

(75) Inventor: Brian J. Herting, Marion, IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 1127 days.

(21) Appl. No.: 11/528,157

(22) Filed: Sep. 27, 2006

(51) Int. Cl.
*H01Q 15/02* (2006.01)

(52) U.S. Cl. ..... 343/909; 333/203

(58) Field of Classification Search ..... 343/909; 333/21 A, 134, 203
See application file for complete search history.

(56) References Cited

U.S. PATENT DOCUMENTS 5,619,366 A * 4/1997 Rhoads et al. ..... 359/248

* cited by examiner

*Primary Examiner*—Tan Ho
(74) *Attorney, Agent, or Firm*—Matthew J. Evans; Daniel M. Barbieri

(57) ABSTRACT

A waveguide switch is shown. The waveguide switch includes a frequency selective surface and a biasing diode configured to selectively provide a short between an outer metal loop and an inner metal loop to place the frequency selective surface into either a non-reflective state or a reflective state.

20 Claims, 5 Drawing Sheets

FREQUENCY SELECTIVE SURFACE WAVEGUIDE SWITCH

BACKGROUND OF THE INVENTION

The present invention relates generally to the field of waveguide switches configured to transmit and/or reflect electromagnetic waves. Specifically, the present invention relates to a waveguide switch including a frequency selective surface configured to reflect and/or transmit electromagnetic waves based on frequency discrimination.

Waveguides consist of four metallic walls, a left and right wall or narrow wall as well as a top and bottom or broad wall. The broad wall of the waveguide is on the order of half a wavelength at the operating frequency, which supports propagation of the lowest order, $TE_{10}$ mode.

Waveguide switches are devices configured to alter the transmission of the electromagnetic wave through the waveguide. Waveguide switches are often used in relatively tight spaces, such that minimizing the size of the switch is desirable. It would be desirable to provide a waveguide switch having a relatively low profile. It would be further desirable to provide such a switch using a cost-efficient material.

What is needed is a switch that provides one or more of these or other advantageous features. Other features and advantages will be made apparent from the present specification. The teachings disclosed extend to those embodiments which fall within the scope of the appended claims, regardless of whether they accomplish one or more of the aforementioned needs.

SUMMARY OF THE INVENTION

One embodiment of the invention relates to a waveguide switch. The waveguide switch includes a frequency selective surface and at least one actuation switch integrated into the frequency selective surface and configured to place the frequency selective surface into either a non-reflective state or a reflective state.

Another embodiment of the invention relates to a switched aperture weather radar array for an aircraft. The weather radar includes an aperture configured to include a plurality of radiating antenna elements. The aperture includes at least first and second portions of the radiating antenna elements. The weather radar further includes a single pole, single throw waveguide switch including a frequency selective surface configured to selectively reflect or transmit electromagnetic waves to control operation of a portion of the weather radar aperture.

Yet another embodiment of the invention relates to a waveguide switch. The waveguide switch includes a frequency selective surface means and at least one actuation switch means integrated into the frequency selective surface means and configured to place the frequency selective surface means into either a non-reflective state or a reflective state.

Alternative examples of other exemplary embodiments are also provided which relate to other features and combinations of features as may be generally recited in the claims.

BRIEF DESCRIPTION OF THE DRAWINGS

The invention will become more fully understood from the following detailed description, taken in conjunction with the accompanying drawings, wherein like reference numerals refer to like elements, in which.

DETAILED DESCRIPTION OF THE PREFERRED EMBODIMENTS

Figure 1:
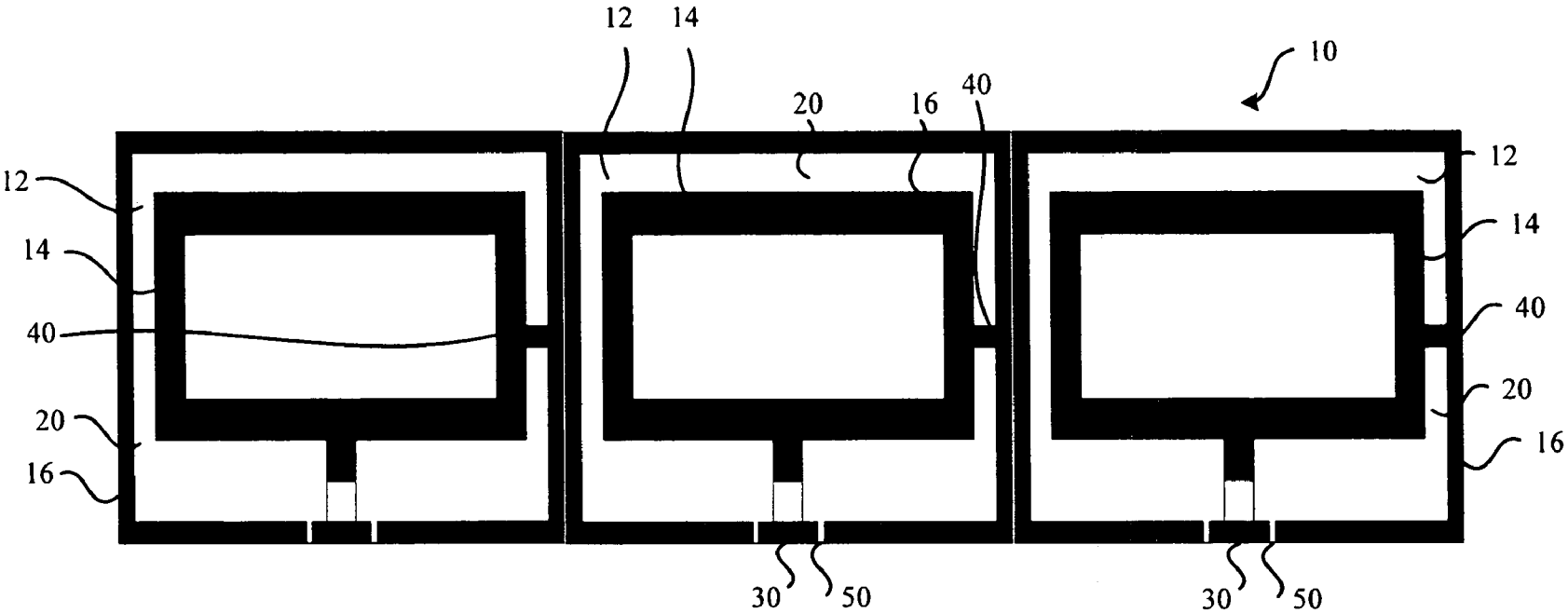
FIG. 1 is a single pole single throw frequency selective surface waveguide switch 10 including a frequency selective surface to selectively reflect and transmit electromagnetic waves, according to an exemplary embodiment.

Before describing in detail the particular improved system and method, it should be observed that the invention includes, but is not limited to, a novel structural combination of conventional semiconductor components and printed microwave circuits, and not in particular detailed configurations thereof. Accordingly, the structure, methods, functions, control, and arrangement of conventional components and circuits have, for the most part, been illustrated in the drawings by readily understandable block representations and schematic diagrams, in order not to obscure the disclosure with structural details which will be readily apparent to those skilled in the art, having the benefit of the description herein. Further, the invention is not limited to the particular embodiments depicted in the exemplary diagrams, but should be construed in accordance with the language in the claims.

Referring now to FIG. 1, a single pole single throw frequency selective surface waveguide switch 10 including a frequency selective surface 20 to selectively reflect and transmit electromagnetic waves is shown, according to an exemplary embodiment. Switch 10 further includes three actuation switches, shown as integrated PIN diodes 30, that are integrated into frequency selective surface structure 20 to be able to make the frequency selective surface selectively opaque or reflective, a ground connection 40, and a bias isolation 50.

Switch 10 may be created on a printed wiring board base 12 and include a series of inner metal loops 14 and outer metal loops 16. When the inner metal loops 14 are shorted to the outer metal loops 16 via forward biased PIN diodes 30, the switch 10 is in the open or reflective state and no power flows through a waveguide in which the switch may be positioned, as described in further detail below. When the inner metal loops 14 are open circuited with respect to the outer metal loops 16 via reverse biased PIN diodes 30, the switch 10 is in the closed position or non-reflective state a power flows through a waveguide in which the switch may be positioned, as described in further detail below. Although the particular example shown in FIG. 1 shows three separate loops and three pin diodes, one of ordinary skill in the art should understand that the number of loops, the implementation of the actuation switch, the number of actuation switches, etc. may be varied to perform the functions described herein.

Frequency selective surface 20 may be any surface construction designed as a filter for plane waves. Frequency selective surface 20 may include periodic arrays of passive elements or slots that act as a band stop or a band pass filter respective to propagating electromagnetic waves. Frequency selective surface 20 may include planar frequency selective surfaces, including printed circuits of substrates, loaded or unloaded elements, and single or multi-layer configurations and non-planar frequency selective surfaces, including periodic dielectric shapes, cross-layer connected elements, etc. For example, as shown in FIG. 1, the printed wiring board base 12 may by the frequency selective surface 20.

Switch 10 further includes integrated diodes 30 configured to alter the bias of frequency selective surface 20. Diode 30 may be modeled using a resistor and a capacitor in series. Integrated diodes 30 may be set to either provide a short, such that frequency selective surface 20 is reflective, or be open such that frequency selective surface 20 is non-reflective. When diodes 30 are not biased on, or are reverse biased, it does not appear as if there is any metal there (an open circuit) and power passes right through switch 10.

According to an alternative embodiment, integrated diode 30 may be implemented as a MicroElectroMechanical Systems (MEMS) switch. MEMS switches generally range in size from a micrometer (a millionth of a meter) to a millimeter (thousandth of a meter) and can provide advantages in lowering the loss of switch 10.

Ground connection 40 may be a short connection positioned horizontally within switch 10 to create a short between inner metal loop 14 and outer metal loop 16. Ground connection 40 may be positioned horizontally in contrast with the vertical polarization of an E-field associated with the waveguide where switch 10 is being used. Where the inner strip is shorted to the outer strip horizontally and on the side, the ground connection does not cause any interference because of the polarization of the E-field. Accordingly, the E-field coming into the waveguide is polarized vertically, such that a thin horizontal ground is will not cause interference. Ground connection 40 may alternatively be positioned vertically for a wave guide having horizontally polarized E-field.

Bias isolation 50 is shown as two broken portions in the metal of the outer loop 16 of switch 10 on each side of where diode 30 is positioned. Bias isolation 50 is configured such that the isolation does not affect the appearance of a connection for RF power. The size of bias isolation may be approximately 3 mils according to an exemplary embodiment.

Figure 2:
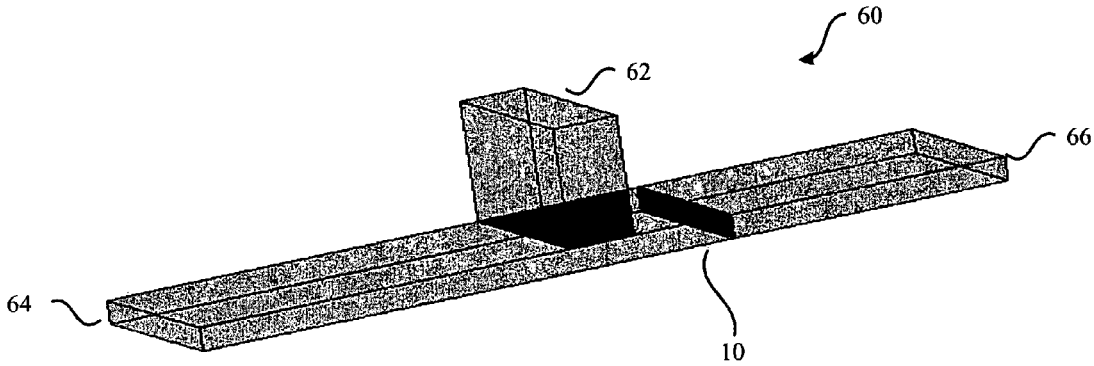
FIG. 2 is an E-plane "T" waveguide junction that incorporates a frequency selective surface waveguide switch, according to an exemplary embodiment.

FIG. 2 is an E-plane "T" waveguide 60 including the frequency selective surface waveguide switch 10, according to an exemplary embodiment. E-plane "T" waveguide 60 includes a first input port 62 receiving power, and a first output port 64 and a second output port 66. An E-plane "T" waveguide is configured, during uninterrupted operation, to equally divide the power applied to first input port 62 though output ports 64 and 66.

Although FIG. 2 shows the waveguide switch 10 in a particular waveguide configuration, it should be understood that switch 10 may be used in any waveguide configuration where a switch is needed. Switch 10 is particularly well suited for use within any waveguide where a low profile and a low amount of power loss are particularly desirable.

Figure 3A:
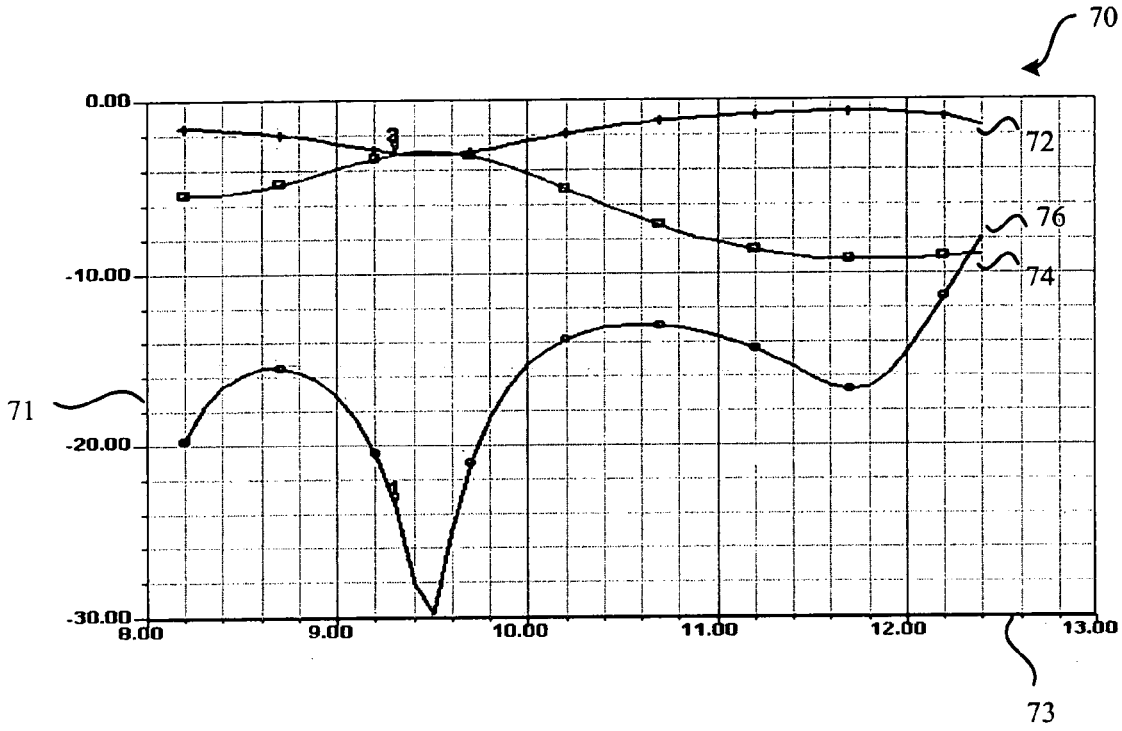
FIG. 3A is a plot graph showing power transmission through the E-plane "T" waveguide of FIG. 2 wherein the diodes are biased "off", according to an exemplary embodiment.

FIG. 3A is a plot graph 70 showing power transmission through the E-plane "T" waveguide 60 of FIG. 2 wherein diodes 30 are biased "off", according to an exemplary embodiment. Graph 70 includes a first plot 72 showing the power reflected back through first input port 62, a second plot 74 showing energy transmission through first output port 64, and a third plot 76 showing power transmission through second output port 66. Graph 70 includes a first axis 71 displaying a power measurement using a log scale representation in dB and a second axis 73 displaying the frequency in GHz.

Accordingly, wherein power is applied to first input port 62 and the first plot 72 shows a value close to zero along first axis 71, the majority of the power applied to first input port 62 was reflected back through first input port 62. Additionally, where second plot 74 and third plot 76 show a value close to zero this provides an indication that all or a majority of the power applied to first input port 62 was transmitted to first output port 64 and second output port 66.

As seen in FIG. 3A, when diodes 30 are biased "off", almost all of the power applied to first input port 62 is successfully transmitted through and equally split amongst first output port 64 and second output port 66, as shown by the near −3 dB values of second plot 74 and third plot 76 at 9 GHz. Additionally, graph 70 shows that very little of the power applied to first input port 62 is reflected back through first input port 62, as shown by the value of first plot 72 that is not near zero at 9 GHz.

Figure 3B:
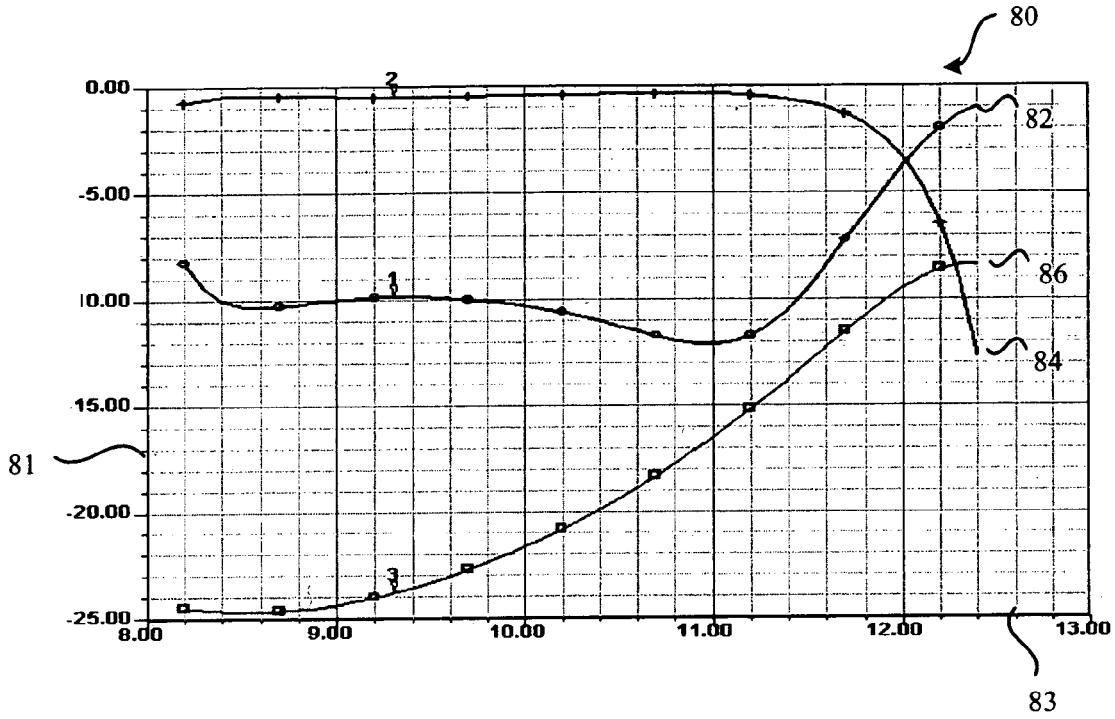
FIG. 3B is a plot graph showing power transmission through the E-plane "T" waveguide of FIG. 2 wherein the diodes are biased "on", according to an exemplary embodiment.

FIG. 3B is a plot graph 80 showing power transmission through the E-plane "T" waveguide 60 of FIG. 2 wherein diodes 30 are biased "on", according to an exemplary embodiment. Graph 80 includes a first plot 82 showing the power reflected back through first input port 62, a second plot 84 showing power transmission through first output port 64, and a third plot 86 showing power transmission through second output port 66. Graph 80 includes a first axis 81 displaying an power measurement using a log scale representation in dB and a second axis 83 displaying the frequency in GHz.

Similar to FIG. 3B, when power is applied to first input port 62 and the first plot 82 shows a value close to zero along first axis 81, the majority of the power applied to first input port 62 was reflected back through first input port 62. Additionally, where second plot 84 and third plot 86 show a value close to zero this provides an indication that all or a majority of the power applied to first input port 62 was transmitted to first output port 64 and second output port 66.

As seen in FIG. 3B, when diodes 30 are biased "on", almost all of the power applied to first input port 62 is successfully transmitted through to only first output port 64 and not through second output port 66, as shown by the near zero value of second plot 84 at 9 GHz. The power through second output port 66 is blocked by the single pole single throw frequency selective surface waveguide switch 10, as shown by the value of the third plot 86 that is not near zero at 9 GHz. Similar to above, graph 80 shows that very little of the power applied to first input port 62 is reflected back through first input port 62, as shown by the value of first plot 82 that is not near zero at 9 GHz.

Figure 4:
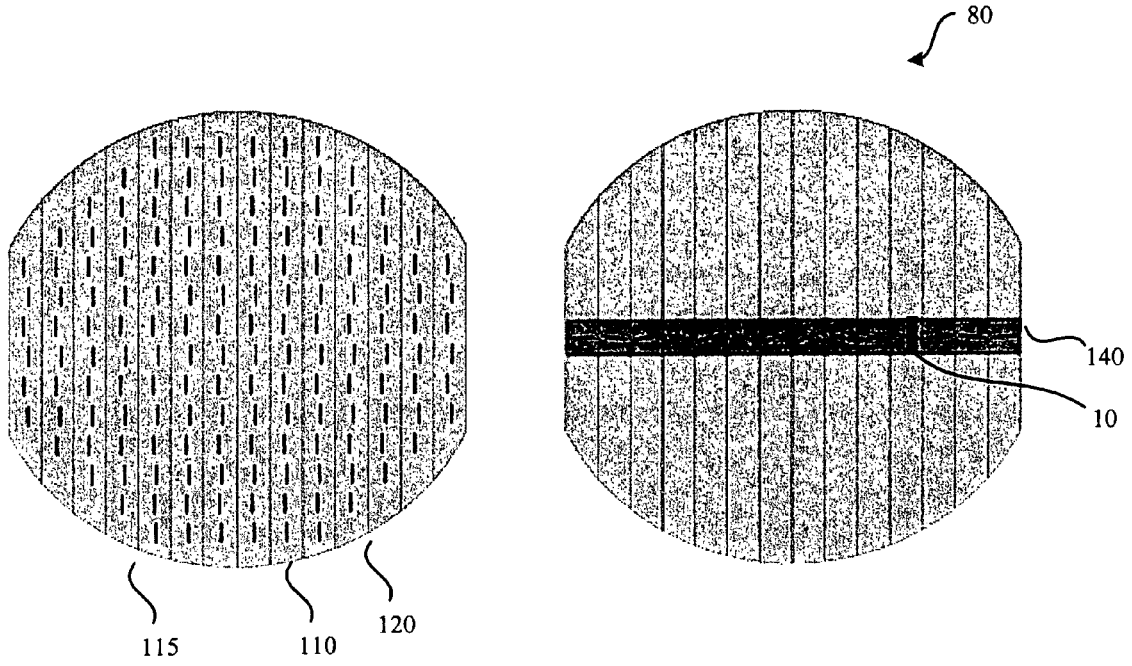
FIG. 4 is a weather antenna radar system including the waveguide switch of FIG. 1, according to an exemplary embodiment.

Referring now to FIG. 4, a weather radar antenna 100 configured to be positioned in the nose of an aircraft is shown, according to an exemplary embodiment. Antenna 100 may be implemented using a flat plate weather radar antenna. Flat plate weather radar antennas is constructed of a series of parallel resonant slotted waveguides. Flat plate weather radar antennas allow for reduced depth into the nose of the aircraft. Reducing the depth is desirable to avoid being forced to decrease the aperture size because of the decreasing diameter of the aircraft nose.

Antenna 100 may be configured to have a front side 110 including a first plurality of radiating slot elements 110, shown on the left half of front side 115, and a second plurality of radiating slot elements 120, shown on the right half of front side 110. Although shown and described herein as divided into two equal half, the radiating slot elements 120 may be divided into any number of portions, equal or unequal portions, etc. Antenna 100 may also include a back side 130 including an input feed 140.

E-plane "T" waveguide 60, described above with reference to FIG. 2, may be used as the input feed 140 on the back of the flat plate weather radar antenna. E-plane "T" waveguide 60 includes slots in the waveguide of first output port 64 and second output port 66 that couple power into radiating guides of a weather radar array system. The aperture size of the weather radar array may be increased by switching a portion of the radiating elements on when switch 10 is in an "off" state. The aperture size of the weather radar array may be decreased by switching a portion of the radiating elements off when switch 10 is in an "on" state.

Although the examples provided herein are directed to use of the waveguide switch within a switched aperture weather radar system, the waveguide switch may alternatively be used in additional applications. Exemplary applications may include any setting wherein a low loss switch is desirable, such as any system using millimeter wave systems, including weather radar, digital broadcasting, satellite broadcasting, etc.

The foregoing description of embodiments of the invention has been presented for purposes of illustration and description. It is not intended to be exhaustive or to limit the invention to the precise form disclosed, and modifications and variations are possible in light of the above teachings or may be acquired from practice of the invention. The embodiments were chosen and described in order to explain the principals of the invention and its practical application to enable one skilled in the art to utilize the invention in various embodiments and with various modifications as are suited to the particular use contemplated.

What is claimed is:

1. A waveguide switch, comprising:

a frequency selective surface;

at least one actuation switch integrated into the frequency selective surface and configured to place the frequency selective surface into either a non-reflective state or a reflective statue;

an inner conductive loop; and an outer conductive loop, wherein the activation switch is configured to provide a short between the inner conductive loop and the outer conductive loop to place the frequency selective surface into the non-reflective state or the reflective state.

2. The waveguide switch of claim 1, wherein the actuation switch is a solid state switch.

3. The waveguide switch of claim 2, wherein the actuation switch is a biasing diode.

4. The waveguide switch of claim 1, wherein the actuation switch is a MEMS switch.

5. The waveguide switch of claim 1, wherein the activation switch includes a pin diode.

6. The waveguide switch of claim 1, wherein the inner and outer conductive loops have a rectangular cross section.

7. The waveguide switch of claim 1, further comprising at least two additional actuation switches and two additional inner and outer conductive loops.

8. The waveguide switch of claim 1, wherein the frequency selective surface includes loaded elements.

9. The waveguide switch of claim 1, wherein the frequency selective surface is planar.

10. The waveguide switch of claim 1, wherein the actuation switch is a pin diode.

11. The waveguide switch of claim 1, wherein the frequency selective surface is a printed wiring board.

12. The waveguide of claim 1, wherein the frequency surface includes periodic dielectric shapes.

13. The waveguide of claim 1, wherein the inner loop and outer conductive loops are connected by a ground connector.

14. The waveguide of claim 13, wherein the ground connector is disposed at respective midpoints of respective lateral sides associated with the inner and outer conductive loops.

15. A waveguide switch, comprising:

a frequency selective surface; and at least one actuation switch integrated into the frequency selective surface and configured to place the frequency selective surface into either a non-reflective state or a reflective state, wherein the actuation switch is a solid state biasing diode, wherein the actuation switch includes an inner metal loop and an outer metal loop and the biasing diode is configured to provide a short between the outer metal loop and the inner metal loop to place the frequency selective surface into the non-reflective state or the reflective state.

16. The waveguide switch of claim 15, wherein the biasing diode further includes a ground connection positioned horizontally to provide a short between the outer metal loop and the inner metal loop.

17. The waveguide switch of claim 15, wherein the outer metal loop includes a broken portion to provide bias isolation for the biasing diode.

18. The waveguide switch of claim 17, wherein the broken portion creates a break of approximately 3 mils.

19. A waveguide switch, comprising:

a frequency selective surface means; and at least one actuation switch means integrated into the frequency selective surface means and configured to place the frequency selective surface means into either a non-reflective state or a reflective state, wherein the actuation switch means includes a solid state biasing diode, wherein the actuation switch means includes an inner metal loop and an outer metal loop and the biasing diode is configured to provide a short between the outer metal loop and the inner metal loop to place the frequency selective surface into the non-reflective state or the reflective state.

20. The waveguide switch of claim 19, wherein the biasing diode further includes a ground connection positioned horizontally to provide a short between the outer metal loop and the inner metal loop.

* * * * *